United States Patent [19]

Tarlow

[11] Patent Number: 4,638,413

[45] Date of Patent: Jan. 20, 1987

[54] COMBINATION SPOTLIGHT AND TABLE LAMP

[76] Inventor: Kenneth Tarlow, 138 Waterview St., Playa del Rey, Calif. 90293

[21] Appl. No.: 671,677

[22] Filed: Nov. 15, 1984

[51] Int. Cl.[4] ..... F21V 13/00

[52] U.S. Cl. ..... 362/242; 362/251; 362/414; 362/426; 362/427

[58] Field of Search ..... 362/227, 235, 236, 246, 362/249, 250, 251, 382, 410, 414, 418, 419, 426, 427

[56] References Cited

U.S. PATENT DOCUMENTS

| | | | |
|---|---|---|---|
| 1,719,401 | 7/1929 | Plaut | 362/227 |
| 2,244,298 | 6/1941 | Icove et al. | 362/242 |
| 2,369,778 | 2/1945 | Feder | 362/414 |
| 3,368,068 | 2/1968 | Cronhom | 362/251 |

*Primary Examiner*—Craig R. Feinberg

*Attorney, Agent, or Firm*—Spensley Horn Jubas & Lubitz

[57] ABSTRACT

A double-lamp system comprising a conventional table lamp fixture and a spotlight fixture mounted on a table lamp base. The position of the spotlight fixture is such that a conventional drum-shaped lamp shade conceals the spotlight fixture from view, yet the spotlight beam's path is unobstructed. In the preferred embodiment, the spotlight beam may be directed as desired by moving the bulb housing laterally, by rotating the bulb housing about a horizontal axis centered on the bulb housing, or by moving the bulb housing through an arc located on the same vertical plane in which the spotlight beam path lies. The spotlight and table lamp may be operated together or separately. In the preferred embodiment, the spotlight fixture comprises a housing for a quartz halogen spotlight bulb and a transformer housing. An incandescent lamp socket, or other suitable type of socket, is integral with the transformer housing in the preferred embodiment. In an alternative embodiment, the incandescent lamp socket is in a housing separate from the transformer housing, with the transformer housing counter-balancing the spotlight bulb housing.

5 Claims, 3 Drawing Figures

COMBINATION SPOTLIGHT AND TABLE LAMP

BACKGROUND OF THE INVENTION

This invention relates to a double-lamp lighting apparatus. In particular, this invention relates to a combination of a conventional table lamp and a spotlight fixture.

A useful convenience for reading is a directional spotlight-type table lamp. However, such directional lamps often do not provide the same area lighting as an ordinary table lamp. Further, having two lamps on one table is often an inconvenience.

In the prior art of double-lamp systems, U.S. Pat. No. 2,777,052 issued to Combs teaches two omni-directional lights, one of which is to be immersed in an aquarium or vase. U.S. Pat. No. 4,385,028 issued to Sundin shows two incandescent lights, one omni-directional and one used to project images on a ceiling. Neither of these inventions is ideally suitable for reading and general area lighting. U.S. Pat. No. 4,337,506 issued to Terada and U.S. Pat. No. 4,388,678 issued to Turner both have an adjustable focused light, but both are only single light systems with reflectors.

The current invention saves the space which a spotlight table lamp and a standard table lamp would take up by integrating a directional spotlight fixture with a table lamp fixture. Using the directional light for reading also saves the energy that would be expended in using a high wattage incandescent bulb to sufficiently illuminate the same object. At the same time, the spotlight is concealed by a conventional lampshade so that it is unobtrusive. Yet because the spotlight fixture is adjustable, the spotlight beam is unobstructed and can be focused in a convenient direction.

BRIEF SUMMARY OF THE INVENTION

The present invention comprises a double-lamp system fixture consisting of a table lamp fixture in combination with an adjustable spotlight fixture. In the preferred embodiment, the table lamp fixture consists of an incandescent socket and an incandescent bulb, and the spotlight fixture consists of an adjustable halogen spotlight. The position and structure of the spotlight fixture is such that the mechanism can be hidden from view by a conventional lamp shade, yet the path of the spotlight beam is unobstructed.

The spotlight fixture in the preferred embodiment comprises a transformer housing, a bulb housing, and an adjustable bracket which connects the transformer and bulb housings. The bracket is attached to the transformer and bulb housings by means of holding pins. Surrounding the pins are either friction rings or raised ridges having detent positions against which the bracket rubs. The pins allow the bracket to be manually moved laterally or to be rotated in a vertical plane. The frictional force provided by the bracket rubbing against the friction rings and/or the detent positions hold the bracket and thus the bulb housing in a desired position. The bulb housing itself also can be pivoted about a horizontal axis centered on the bracket holding pins affixed to the bulb housing. The entire spotlight mechanism is in such a position that a lamp shade conceals the mechanism from the viewer, yet does not obstruct the spotlight beam.

An incandescent socket is integrally combined with the transformer housing, which is affixed just above the lamp body. There are separate switches for the incandescent light and spotlight, so that each light may be operated separately or together as desired.

BRIEF DESCRIPTON OF DRAWINGS

For a better understanding of the invention, reference may be made to the accompanying drawings, in which.

Like reference numbers in the figures refer to like elements.

DETAILED DESCRIPTION OF THE INVENTION

Figure 1:
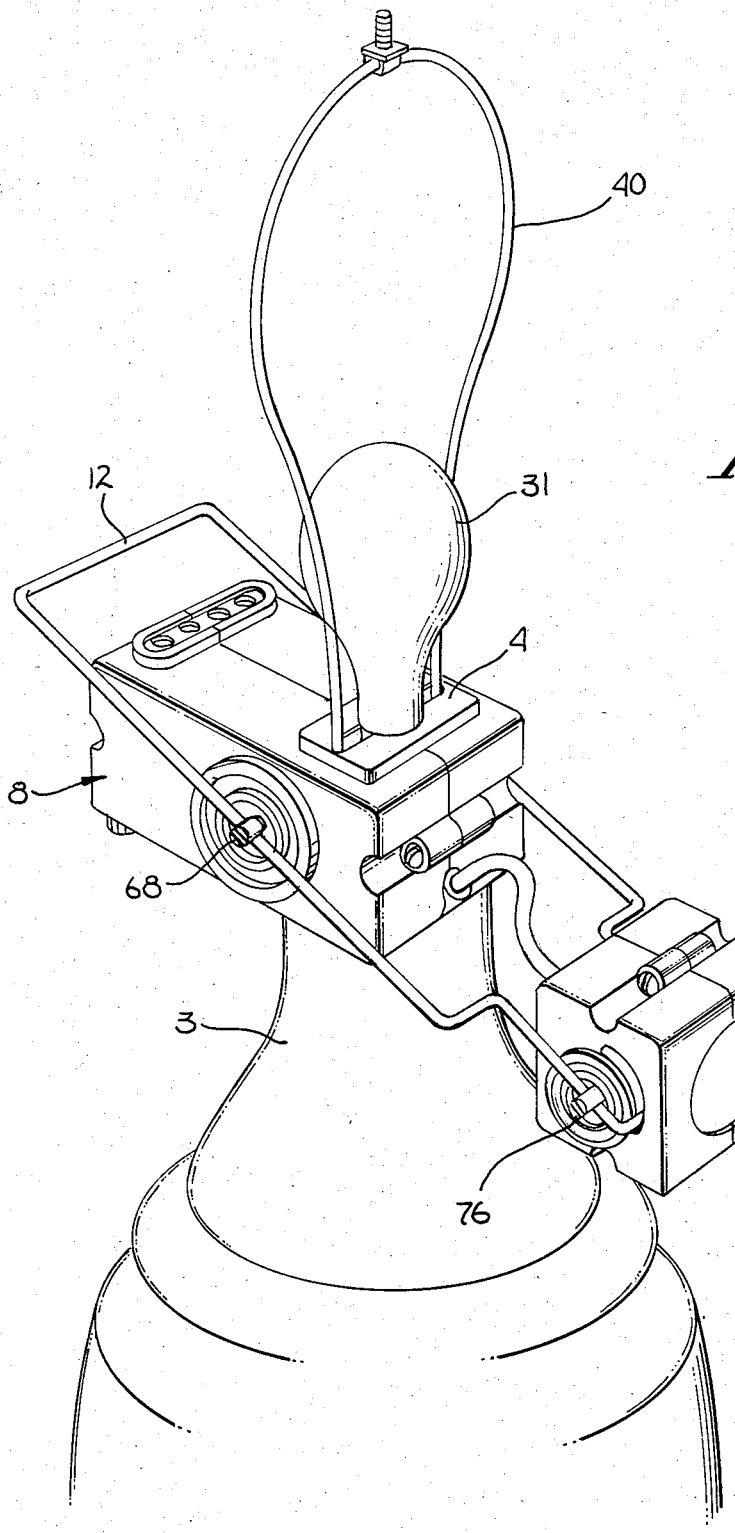
FIG. 1 is a perspective view of the combination table lamp and spotlight fixture in a preferred embodiment.

Referring to FIG. 1, there is shown a perspective view of a double-lamp system 1 comprising a spotlight fixture 2 and integral incandescent lamp socket 4 mounted on a table lamp base 3. The spotlight fixture 2 comprises a transformer housing 8, a bulb housing 10, and a connecting bracket 12. An incandescent bulb 31 (or any bulb having a standard incandescent bulb threaded base) is screwed into the incandescent lamp socket 4. The transformer housing 8 also contains a mounting bracket (shown in FIG. 2) for supporting a lamp harp 40.

Figure 2:
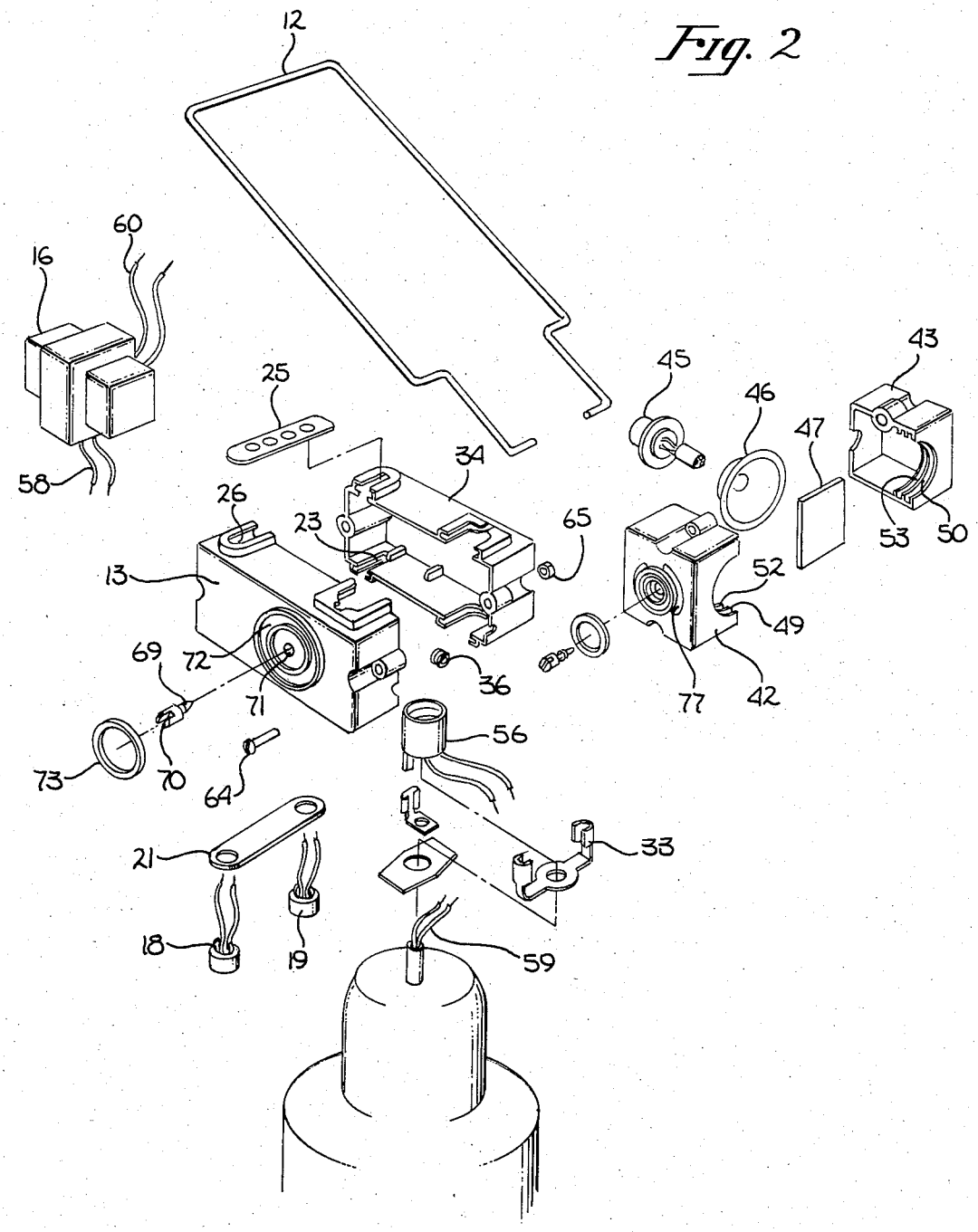
FIG. 2 is an exploded view of the transformer and bulb housings.

Referring to FIG. 2, the transformer housing 8 comprises a left half 13 and a right half 14, which are identical, substantially hollow rectangular bodies with one side open. In a preferred embodiment, the transformer halves 13 and 14 are molded of plastic, and are identical and symmetrical so that only one mold need be used for manufacture, thus decreasing the cost of manufacture. The transformer housing 8 contains a transformer 16, which fits mechanically between the two transformer housing halves 13 and 14. The ends of a switch holder 21 fit mechanically into a slot 23 of the right transformer housing half 14 and an identical slot in the left transformer housing half 13. Two switches 18 and 19 fit into apertures in the switch holder 21 such that the toggle or button ends of the switches 18 and 19 protrude from the underside of the transformer housing 8. Above the switches 18 and 19 is a vent plate 25, the ends of which fit into slots 26 and 27 of the left and right transformer housing halves 13 and 14, respectively.

In the preferred embodiment, the transformer housing 8 is mounted on the table lamp base 3 around an incandescent socket 30, which is integral with the transformer housing 8. A socket bracket 32 supports the incandescent socket 30. The socket bracket 32 rests on a harp support 33 which in turn rests on a rectangular washer 34. The ends of the rectangular washer 34 fit into a slot 36 in the right transformer housing half 14 and an identical slot in the left transformer housing half 13. A threaded rod 38, which is integral with and protrudes from the lamp base 3, threads through apertures in the rectangular washer 34, the harp support 33, and the socket bracket 32. The harp support 33 holds a conventional harp 40 upright.

In an alternative embodiment, integral harp retainers are molded into the transformer housing 8, thus eliminating the need for the separate harp support 33.

The bulb housing 10, like the transformer housing 8, comprises a left half 42 and a right half 43, which are substantially hollow rectangular bodies with one side open. In the preferred embodiment, the bulb housing halves 42 and 43 are molded of plastic, and are identical and symmetrical, so that only one mold need be used for manufacture. The bulb housing serves as a container for a spotlight bulb 45, a concave reflector 46, and a glass plate 47, preferrably heat resistant. In the preferred embodiment, the spotlight bulb is a halogen spotlight bulb. The glass plate 47 fits mechanically into slots 49 and 50. Similarly, the concave reflector 31 fits mechanically into slots 52 and 53. The concave reflector 46 has an aperture in the center through which the bulb portion of the spotlight bulb 45 protrudes.

Electrical connections are made as follows: Leads 56 of the incandescent socket 30 and input leads 58 of the transformer 16 connect through the switches 18 and 19 to electrical leads 59 of the lamp base 3. Output leads 60 of the transformer 16 pass through an aperture in the transformer housing 8, through an aperture in the bulb housing 10, and are connected to the spotlight bulb 45. A rubber grommet 63 may be fitted into the aperture in the transformer housing 8 to prevent the output leads 60 of the transformer 16 from scraping against the edges of the aperture.

In an alternative embodiment, the transformer 16, switches 18, 19 and incandescent socket 30 can be premounted on a printed circuit board, which then may be mechanically fitted into the slots 23 of the transformer housing 8.

In the preferred embodiment, screws and nuts such as screw 64 and nut 65 fasten together the transformer housing halves 13 and 14 as well as the bulb housing halves 42 and 43, but other suitable fastening means may be used, such as rivets, glue, plastic friction fit fasteners, plastic welding of the housings, etc.

Referring to FIG. 1 and FIG. 2, a bracket 12 connects the bulb housing 10 to the transformer housing 8. The bracket 12 slidably and rotatably attaches to the left transformer housing half 13 at a first joint 68. The first joint 68 comprises a bracket holding pin 69 having an aperture 70 through which the bracket 12 slidably fits. The bracket holding pin 69 rotatably fits in a center aperture 71 at the center of an annular depression 72 in the left transformer housing half 13. The bracket 12 can thus rotate about a horizontal axis AA' which goes through the center aperture 71 and is perpendicular to the bracket 12. The first joint 68 further comprises a friction ring 73, which fits in the annular depression 72. The bracket 12 rubs against the friction ring 73 which prevents the bracket 12 from freely sliding or rotating. The bracket 12 attaches to the right transformer housing half 14 in an identical manner at a second joint identical to the first joint 68. In an alternative embodiment, a raised ridge similar in shape and function to the friction ring 73 but having detent positions can be molded into each half of the transformer housing 8.

The bracket 12 further attaches to the left bulb housing half 42 at a third joint 76, and the right bulb housing half 43 at a fourth joint. The third joint 76 and the fourth joint are essentially identical to the first joint 68, except that the tips of the bracket 12 are bent towards each other and slidably fit into a first arc-shaped aperture 77 in the left bulb housing half 42 and a second arc-shaped aperture, identical to the first arc-shaped aperture 77, in the right bulb housing half 43. The first arc-shaped aperture 77 and the second arc-shaped aperture restrict the rotation of the bulb housing 10 about a horizontal axis BB' centered on the centers of the third joint 76 and the fourth joint.

The spotlight beam is adjusted to a desired position by manually rotating the bulb housing 10 around the axis BB', by moving the bulb housing 10 laterally by sliding the bracket 12 through the apertures 70 of the first and second joints, or by rotating the bulb housing 10 and bracket 12 about the axis AA'.

Figure 3:
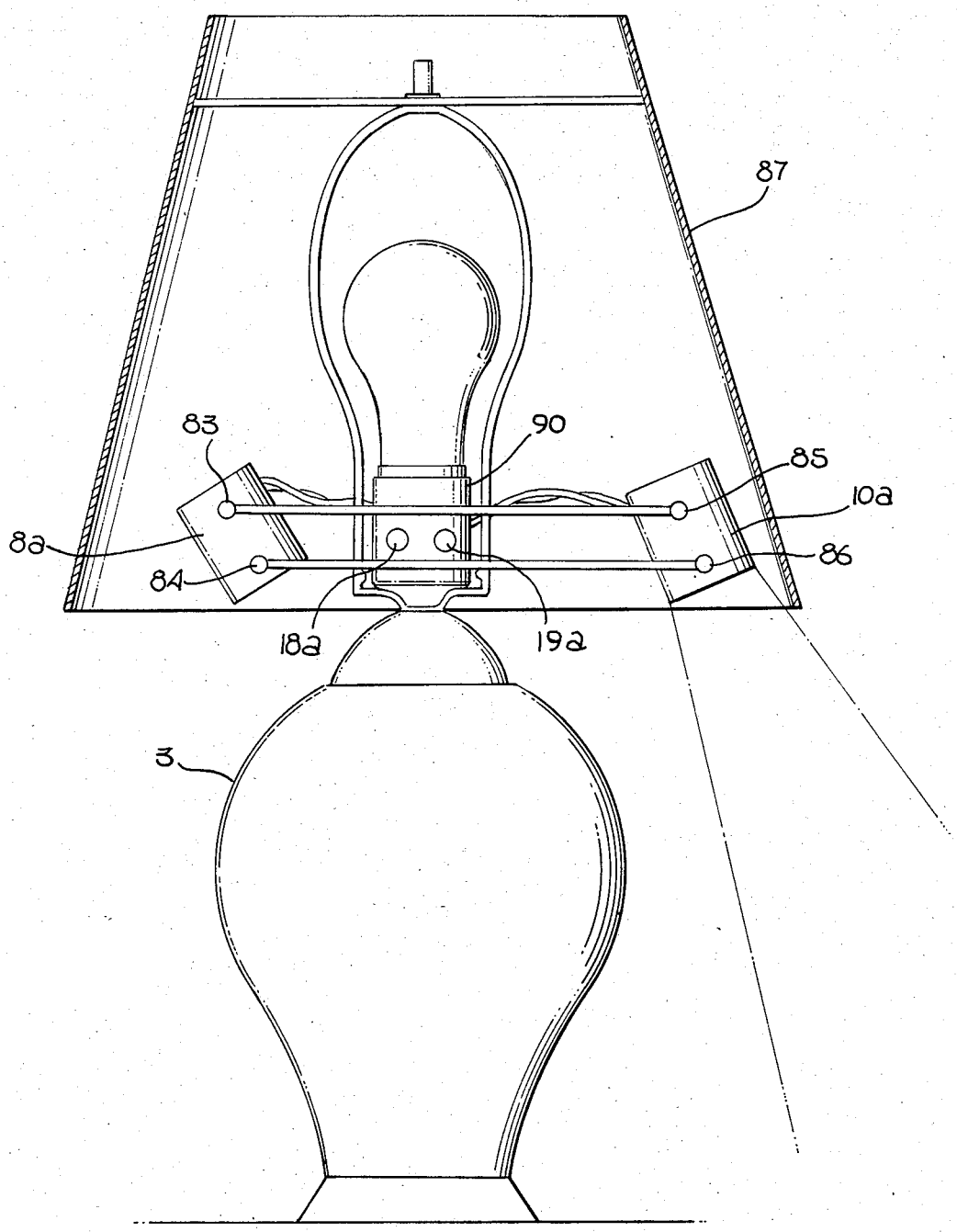
FIG. 3 is a perspective view of an alternative embodiment of the combination table lamp and spotlight fixture, with an alternative placement and structure for the transformer housing.

An alternative embodiment of the invention is shown in FIG. 3 with the transformer housing **8*a* on the side of the table lamp base 3 opposite of the bulb housing 10*a*, thus acting as a counterweight for the bulb housing 10*a*. The light switches 18*a* and 19*a* can be attached directly to an incandescent socket housing 90 or some other convenient place. Straight bars 80 and 81 are connected to the bulb housing 10*a* and the transformer housing 8*a* by means of bar holder pins 83, 84, 85, and 86. Identical bars are attached to the transformer housing 8*a* and the bulb housing 10*a* in an identical manner on the opposite side of the table lamp base 3. FIG. 3 shows how a conventional drum-shaped lamp shade 87 conceals the bulb housing 10*a* and the transformer housing 8*a*. In the preferred embodiment of the invention as shown in FIGS. 1 and 2, a drum-shaped lamp shade, similar to the lamp shade 87 shown in FIG. 3, conceals the bulb housing 10 and the transformer housing 8** in a similar fashion.

While a preferred embodiment and an alternative embodiment of the present invention have been described in detail, it should be understood that changes can be made in the embodiments of the invention without departing from the spirit or scope of the invention. For example, a spotlight bulb that does not require power transformation could be substituted for the halogen spotlight fixture described herein. In such a case, the transformer housing described in conjunction with the preferred embodiment would not be necessary, and the structure of the lamp would be simplified accordingly. Thus, this invention is not to be limited to the specific embodiment discussed and illustrated herein, but rather by the following claims.

I claim:

1. A combination electrical spotlight and table lamp, comprising:

(a) a spotlight fixture;

(b) a lamp fixture surrounding and eccentrically offset to a lamp socket with a central longitudinal axis; and (c) an extension element, pivotally attached to a portion of the lamp fixture which is longitudinally offset to the socket and extending past and away from the central axis of the lamp socket, wherein the spotlight fixture is pivotally attached to the extension element at a location offset from the socket central axis in a direction opposite said offset portion.

2. The combination electrical spotlight and table lamp of claim 1, wherein the extension element is slidably adjustable with respect to the lamp fixture, wherein the spotlight fixture can be adjustably spaced from the lamp fixture.

3. The combination electrical spotlight and table lamp of claim 1, wherein an electrical power conversion means is disposed within the lamp fixture and coupled to said spotlight fixture.

4. A combination electrical spotlight and table lamp, comprising:

(a) a spotlight fixture;

(b) a lamp fixture, including a lamp socket with a central longitudinal axis;

(c) electrical power conversion means, electrically coupled to the spotlight fixture, for supplying converted electrical power to the spotlight fixture; and (d) an extension element pivotally attached to the lamp fixture and extending away from the central axis of the lamp socket, wherein the spotlight fixture is pivotally attached adjacent one end of the extension element at a location offset from the socket central axis, and the power conversion means is attached at an opposite end of the extension element at a location offset from the socket centrla axis with said lamp socket being located between said spotlight fixture and said power conversion means.

5. A combination spotlight and table lamp, comprising:

(a) a lamp fixture having a lamp socket with a central longitudinal axis;

(b) an extension element, rotatably attached to the lamp fixture, extending away from the central axis of the lamp socket;

(c) a spotlight fixture rotatably attached to the extension element at a location offset from the socket central axis; and (d) electrical power conversion means, rotatably attached to the extension element at a location offset from the lamp socket central axis and opposite the light fixture from the spotlight fixture, for supplying converted electrical power to the spotlight fixture.

* * * * *